US010125942B2

(12) United States Patent
Park

(10) Patent No.: US 10,125,942 B2
(45) Date of Patent: Nov. 13, 2018

(54) LAMP APPARATUS FOR AUTOMOBILE

(71) Applicant: Hyundai Mobis Co., Ltd., Seoul (KR)

(72) Inventor: Jun Sung Park, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 107 days.

(21) Appl. No.: 14/706,583

(22) Filed: May 7, 2015

(65) Prior Publication Data

US 2015/0345726 A1 Dec. 3, 2015

(30) Foreign Application Priority Data

Jun. 2, 2014 (KR) ..... 10-2014-0067134

(51) Int. Cl.
*F21S 43/20* (2018.01)
*F21S 43/14* (2018.01)

(52) U.S. Cl.
CPC ..... *F21S 43/26* (2018.01); *F21S 43/14* (2018.01)

(58) Field of Classification Search
CPC ..... F21S 48/1225; F21S 48/225
See application file for complete search history.

(56) References Cited

U.S. PATENT DOCUMENTS 6,367,950 B1 * 4/2002 Yamada ..... F21S 48/215 362/241
6,527,411 B1 * 3/2003 Sayers ..... F21S 48/1154 362/237
6,536,923 B1 3/2003 Merz
6,724,543 B1 * 4/2004 Chinniah ..... F21S 48/2212 359/718
6,755,556 B2 * 6/2004 Gasquet ..... F21S 48/2212 362/328
7,213,945 B2 * 5/2007 Yoneda ..... H01L 33/58 257/E33.071
7,506,999 B2 * 3/2009 Uchida ..... F21S 48/215 362/245
7,580,192 B1 8/2009 Chu et al.
2004/0090790 A1 * 5/2004 Ishida ..... F21S 48/1154 362/507
2005/0201118 A1 9/2005 Godo
2006/0098308 A1 * 5/2006 Angelini ..... F21K 9/00 359/820
2008/0130137 A1 6/2008 Angelini et al.
2008/0310028 A1 12/2008 Chinniah et al.
(Continued)

FOREIGN PATENT DOCUMENTS

CN 101922667 12/2010
CN 1020889533 1/2013
(Continued)

*Primary Examiner* — Jong-Suk (James) Lee
*Assistant Examiner* — Christopher E Dunay
(74) *Attorney, Agent, or Firm* — H.C. Park & Associates, PLC

(57) ABSTRACT

A lamp apparatus for an automobile, including: a light source generating light; and a first lens distributing the light to the outside and including a first cavity therein, and the first lens includes a light spreading unit of which one side is convex toward the light source and the other side opposite the one side is flat, and a side portion connected with the one side of the light spreading unit and having a diameter which increases in a first direction away from the light source.

9 Claims, 5 Drawing Sheets

(56) References Cited

U.S. PATENT DOCUMENTS

| | | | | |
|---|---|---|---|---|
| 2009/0034277 | A1* | 2/2009 | Okada | F21S 48/24 362/509 |
| 2012/0020103 | A1* | 1/2012 | Okada | B60Q 1/2607 362/510 |
| 2013/0021815 | A1 | 1/2013 | Koizumi | |
| 2014/0085919 | A1 | 3/2014 | Tsai et al. | |
| 2014/0316742 | A1* | 10/2014 | Sun | G02B 19/0066 702/167 |
| 2016/0265734 | A1* | 9/2016 | Kanayama | F21S 48/328 |
| 2016/0272116 | A1* | 9/2016 | Wu | B60Q 9/008 |

FOREIGN PATENT DOCUMENTS

| | | |
|---|---|---|
| CN | 103672664 | 3/2014 |
| DE | 10 2008 061 688 | 6/2010 |
| EP | 2211087 | 7/2010 |
| JP | 2003-232994 | 8/2003 |
| JP | 2005-258159 | 9/2005 |
| JP | 2009-070575 | 4/2009 |
| KR | 10-2013-0106097 | 9/2013 |
| KR | 10-2014-0040631 | 4/2014 |

* cited by examiner

LAMP APPARATUS FOR AUTOMOBILE

CROSS-REFERENCE TO RELATED APPLICATION

This application claims priority from and the benefit of Korean Patent Application No. 10-2014-0067134, filed Jun. 2, 2014, which is hereby incorporated by reference for all purposes as if fully set forth herein.

BACKGROUND

Field

Exemplary embodiments of the present invention relate to a lamp apparatus for an automobile. More particularly, exemplary embodiments of the present invention relate to a lamp apparatus for an automobile, which includes a lens having a cavity.

Discussion of the Background

An automobile is a means of transportation that produces power in its own engine and transmits the produced power to wheels so as to transport passengers or freight on a road. The automobile may be largely divided into a body forming an exterior structure and a chassis in which various devices are connected. The chassis includes primary devices, including a power transmission device, a steering device, a suspension device, a braking device, and the like, in addition to the automobile engine as a motive power source for driving.

In general, various lamp apparatuses are mounted at front and rear sides of the automobile to provide safety and driving convenience of the automobile and the lamp apparatus includes a headlamp, a tail lamp, a turn signal lamp, and the like.

In recent years, as a light source of the lamp apparatus, a plurality of light emitting diodes has been primarily used (related art, Korean Patent Unexamined Publication No. 10-2013-0106097).

Meanwhile, a research into configuring a lens so as to reduce manufacturing cost while more efficiently distributing light generated from the light source of the lamp apparatus has been required.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the present invention provide a lamp apparatus for an automobile, which includes a lens having a cavity to reduce manufacturing cost while more efficiently distributing light.

Additional aspects will be set forth in the detailed description which follows, and, in part, will be apparent from the disclosure, or may be learned by practice of the inventive concept.

An exemplary embodiment of the present invention discloses a lamp apparatus for an automobile, including: a light source generating light; and a first lens distributing the light to the outside and including a first cavity therein. The first lens includes a light spreading unit, of which one side is convex toward the light source and the other opposing side is flat, and a side portion connected with the one side of the light spreading unit and having a diameter which increases in a first direction away from the light source.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
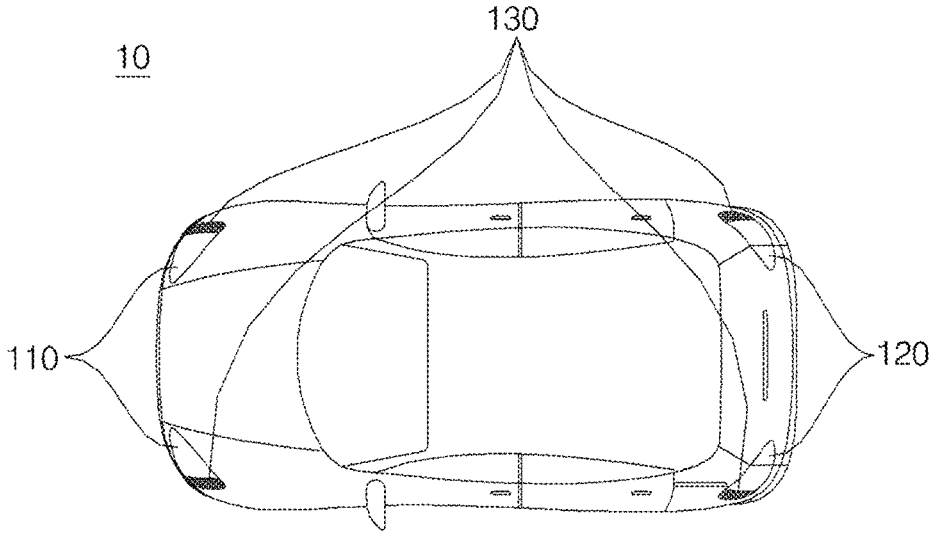
FIG. 1 is a top view diagram for describing a lamp apparatus provided in a vehicle according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a diagram of a lamp apparatus provided in a vehicle according to an exemplary embodiment of the present invention.

Referring to FIG. 1, the vehicle 10 may include head lamps 110, tail lamps 120, and turn signal lamps 130, where brake lamps are usually housed along with the tail lamps 120.

The head lamp 110 is a lamp apparatus that is attached to a front side of the vehicle to secure a view by lighting up a front while driving at night. The head lamp 110 may be largely divided into a unit driving type head lamp and a reflector driving type head lamp. The unit driving type head lamp includes an assembly type, a semi-shield beam type, a shield beam type, a metal back shield beam type, and a project type. Initially, the assembly type is primarily used, in which lens bulb reflectors are separately assembled, but lamp efficiency decreases as a result of exposure to high humidity or dust, and as a result, in recent years, the shield beam type having an integrated structure has been primarily used.

The head lamp 110 generally requires a sufficient brightness to verify the presence of an object which is distant at a distance of 100 m to the front in the dark. The head lamp 110 may have a low-beam function to lower the aim of the light beam downward, and a high-beam function to raise the aim of the light beam upward. Various types of light sources used in the head lamp may include halogen, a high-intensity discharge (HID) type, the LED, and the like.

The tail lamp 120 as a lamp apparatus attached to the rear side of the vehicle is automatically turned on when the head lamp 110 is turned on. When a driver steps on a brake pedal, the brake lamp is a lamp apparatus that is automatically turned on in order to warn the driver of a following vehicle.

The turn signal lamp 130 is a lamp apparatus that is attached to the front side, the rear side, or a side mirror of the vehicle to intermittently emit light when the vehicle changes its direction or in order to notify a temporary risk state to other vehicles.

The head lamp 110, the tail lamp 120, brake lamp, and the turn signal lamp 130 include light sources generating light and lenses distributing light generated from the light sources to the outside. Herein, a light emitting diode (LED) may be used as the light source. In the following description, an LED is assumed to be the light source, but the light source is not limited thereto. That is, it is apparent to those skilled in the art that a light emitting device other than the LED may be used as the light source.

FIG. 2 is a diagram illustrating a lamp apparatus for an automobile, which includes an LED as a light source.

Figure 2A:
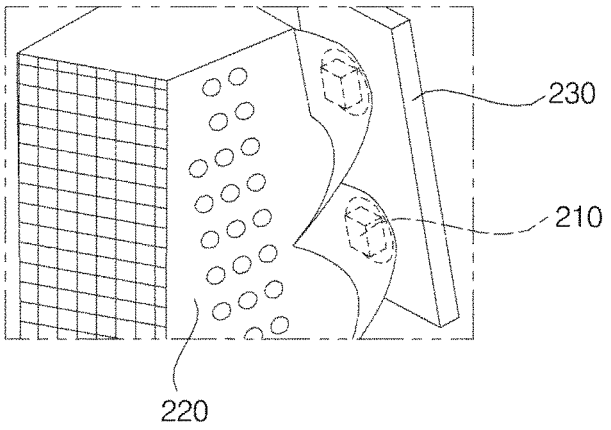
FIG. 2A and FIG. 2B are diagrams illustrating a lamp apparatus for an automobile, which includes a light-emitting diode (LED) as a light source.
Figure 2B:
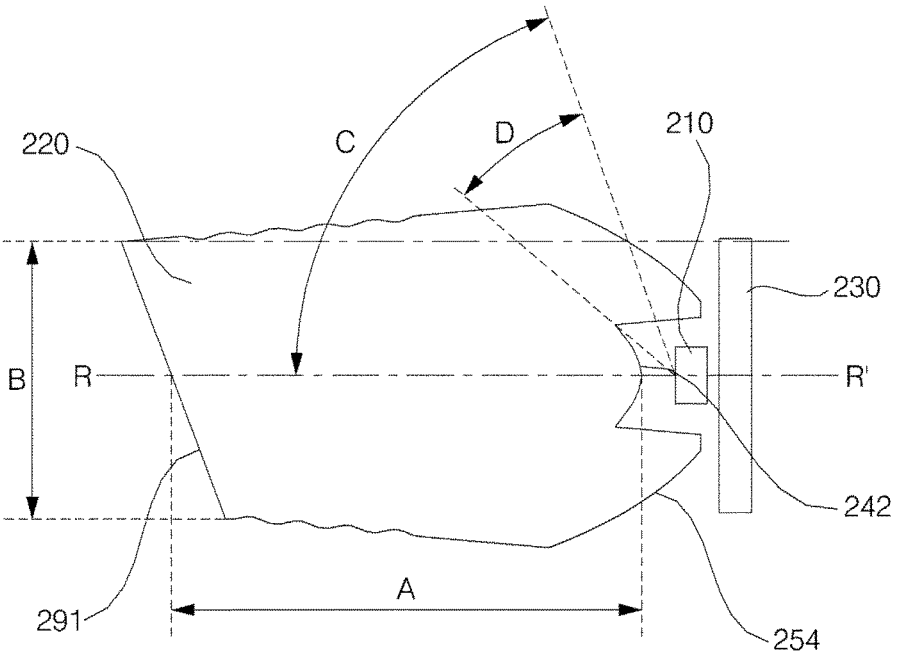

FIG. 2A is a partial perspective view of the lamp apparatus for the automobile. FIG. 2B is a diagram illustrating a side view of the lamp apparatus for the automobile.

Referring to FIG. 2A, the lamp apparatus for the automobile may include a light source 210 and a lens 220.

At least one light source 210 may be mounted on a substrate 230. Power is applied to the light source 210, which generates and discharges light, and the brightness of the light source 210 may vary depending on the amount of the applied power. Further, the color temperature may vary depending on the power of the light source 210, and a color of the emitted light may be varied by combining red (R), green (G), and blue (B) colors in various proportions. For example, a color of light emitted from a fluorescent substance included in the light source 210 may be varied by the combination of the red (R), the green (G), and the blue (B) colors.

The lens 220 may be made of a transparent material in order to minimize optical loss. For example, the lens 220 may be made of a synthetic resin or glass made of a transparent material. Herein, the synthetic resin may be an epoxy resin, a silicon resin, or a urethane resin.

A thickness A of the lens 220 may be greater than or equal to 15 mm, or less than or equal to 25 mm. The thickness A of the lens 220 may be 20 mm. A height B of the lens 220 may be greater than or equal to 11 mm, or less than or equal to 21 mm. The height B of the lens 220 may be 16 mm. Based on numerical values of the thickness A and the height B when the lens 220 is formed, the optical loss may be minimized and emission efficiency may be maximized.

The lens 220 may include the curved portion 242 and the outer surface 254 that are convex toward the light source 210, as shown in FIG. 2B. The curved portion 242 and the outer surface 254 will be described in detail with reference to FIG. 2B.

An angle C at which light is spread upward around a central axis R-R' may be about 60°. That is, both angles at which light is aimed upward and downward may be 120°. Further, an angle D at which light is spread from an upper end to the upper outer surface 254 of the curved portion 242 may be about 27°.

In the lamp apparatus for the automobile illustrated in FIG. 2B, light is diffusion-reflected in an area from the end to the outer surface 254 of the curved portion 242. Therefore, optical loss may occur. Further, light flow pattern depends on whether an inclination angle of an exterior surface 291 of the lens 220 is large. Therefore, the light efficiency may deteriorate. Because the entirety of the inside of the lens 220 is made of the transparent material, productivity deteriorates and a weight increases.

Figure 3A:
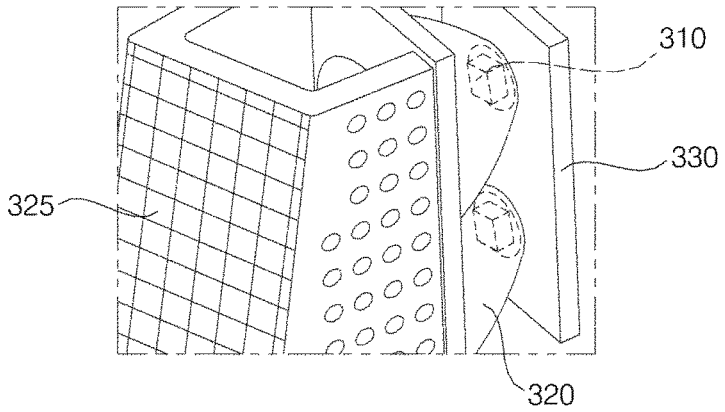
FIG. 3A and FIG. 3B are diagrams showing a lamp apparatus for an automobile according to an exemplary embodiment of the present invention.
Figure 3B:
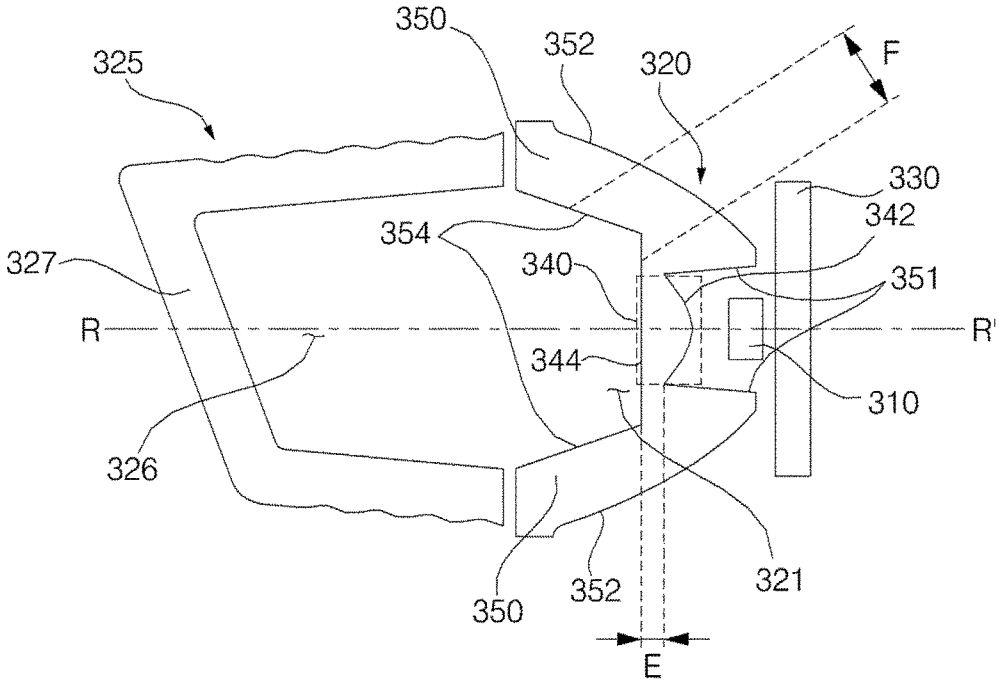

FIG. 3A and FIG. 3B are diagrams showing a lamp apparatus for an automobile according to an exemplary embodiment of the present invention.

FIG. 3A is a partial perspective view of a lamp apparatus for an automobile according to an exemplary embodiment of the present invention. FIG. 3B is a diagram illustrating a side view of the lamp apparatus for the automobile according to the exemplary embodiment of the present invention.

Referring to FIG. 3A, the lamp apparatus for the automobile may include a light source 310, a first lens 320, and a second lens 325.

At least one light source 310 may be mounted on a substrate 330. Power is applied to the light source 310, which generates and discharges light and the brightness of the light source 310 may vary depending on the amount of the applied power. Further, the color temperature may vary depending on the power of the light source 310, and a color of the emitted light may be varied by combining red (R), green (G), and blue (B) colors in various proportions. For example, a color of light emitted from a fluorescent substance included in the light source 310 may be varied by the combination of the red (R), green (G), and blue (B) colors.

The first lens 320 may be made of a transparent material in order to minimize optical loss. For example, the first lens 320 may be made of a synthetic resin or glass made of a transparent material. Herein, the synthetic resin may be an epoxy resin, a silicon resin, or a urethane resin.

The first lens 320 distributes the light generated from the light source 310 to the outside. The first lens 320 may include a first cavity 321 therein, as shown in FIG. 3B.

The first lens 320 may include a light spreading unit 340 and a side portion 350.

One side of the light spreading unit 340 may be convex toward the light source 310 and the other side opposite to the one side may be flat. For example, the light spreading unit 340 may include a curved portion 342, which is convex toward the light source 310, and a first inner bottom surface 344, which is flat and opposes the curved portion 342.

Meanwhile, a length E from the first bottom surface 344 to an outer circumference of the curved portion 342 may be greater than or equal to 1 mm and less than or equal to 2.5 mm.

The first lens 320 includes the curved portion 342 which is convex toward the light source 310 and the first inner bottom surface 344, which is flat to increase light distribution efficiency.

The side portion 350 is connected with the outer circumference of the curved portion 342 and may be formed in such a manner that the diameter increases in a first direction away from the light source 310. Herein, the first direction may be a direction toward R and away from R' in FIG. 3B. The side portion 350 may include a first inner surface 351, an outer surface 352, and a second inner surface 354.

The first inner surface 351 extends toward the light source 310 on the outer circumference of the curved portion 340. The first inner surface 351 may be formed to surround the light source 310.

The outer surface 352 is formed to form a predetermined angle with the first inner surface 351 at one side of the first inner surface 351. In this case, the angle between the first inner surface 351 and the outer surface 352 may be greater than or equal to 10° and less than or equal to 90° when viewed from the side. The outer surface 351 is formed in such a manner that the diameter increases toward the first direction away from the light source 310.

The second inner surface 354 extends on the outer circumference of the first inner bottom surface 344. The second inner surface 354 is formed to form a predetermined angle with the first inner bottom surface 344. In this case, the angle between the first inner bottom surface 344 and the second inner surface 354 may be greater than or equal to 90° and less than or equal to 180° when viewed from the side.

Light efficiency increases as a result of the first inner bottom surface 344 and the second inner surface 354. Diffused-reflection decreases as compared with the lamp apparatus for the automobile described with reference to FIGS. 2A and 2B. Further, the first cavity 321 is included in the first lens 320 to be manufactured by a general injection machine, thereby reducing manufacturing costs. Further, weight may decrease as large as the volume of the first cavity 321 and fuel efficiency of the vehicle may increase. In addition, as the first lens 320 may be manufactured by the general injection machine, a manufacturing cycle time may also decrease.

The second lens 325 distributes the light generated from the light source 310 to the outside. The second lens 325 may be formed to contact the first lens 320. The second lens 325 may include a second cavity 326 therein.

The second lens 325 may include an inclination portion 327 having a predetermined slope with the first direction. In this case, the slope may be greater than or equal to 45° and less than or equal to 90° based on the first direction. The lamp apparatus for the automobile according to an exemplary embodiment of the present invention includes the second lens 325 including the inclination portion 327 to achieve 3D lighting.

The second lens 325 may be made of the transparent material in order to minimize the optical loss. For example, the second lens 325 may be made of the synthetic resin or glass made of the transparent material. Herein, the synthetic resin may be an epoxy resin, a silicon resin, or a urethane resin.

Figure 4A:
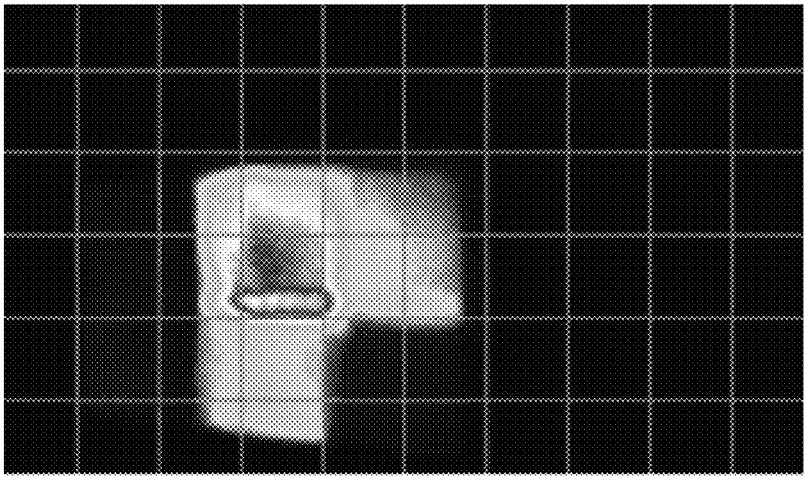
FIG. 4A is a diagram illustrating a light efficiency test of the lamp apparatus for an automobile using an LED as a light source.

FIG. 4A is a diagram illustrating a light efficiency test of the lamp apparatus for an automobile using an LED as a light source.

Figure 4B:
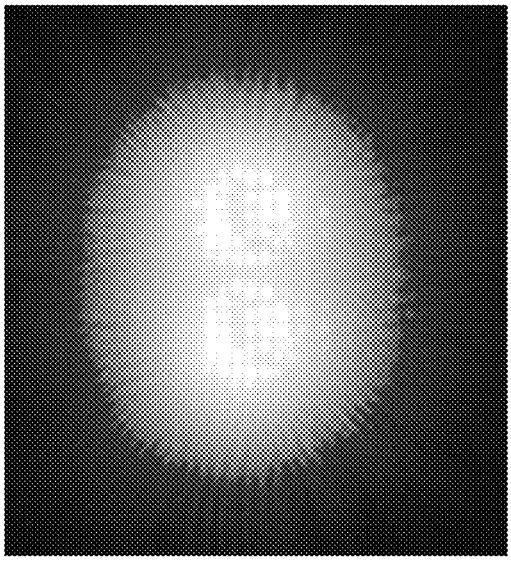
FIG. 4B is a diagram illustrating a lighting image of the lamp apparatus for an automobile using the LED as the light source.

FIG. 4B is a diagram illustrating a lighting image of the lamp apparatus for an automobile using the LED as the light source.

FIGS. 4A and 4B illustrate a test result using the lamp apparatus for the automobile described with reference to FIGS. 2A and 2B.

The diagram illustrated in FIG. 4A illustrates an image acquired by photographing the lamp apparatus for the automobile including one 0.2 watt red (R) LED light source under a condition of a 25° combined inclination angle, which emits light. In this case, the lamp apparatus distributes light of 8.9 cd and a phenomenon in which a light distribution pattern concentrates on left and lower sides may be verified.

The diagram illustrated in FIG. 4B illustrates a lighting image acquired by photographing the lamp apparatus for the automobile including two red (R) LED light sources in a front direction, which emits light. In this case, it can be seen that the lamp apparatus shows emission efficiency at a normal level.

Figure 5A:
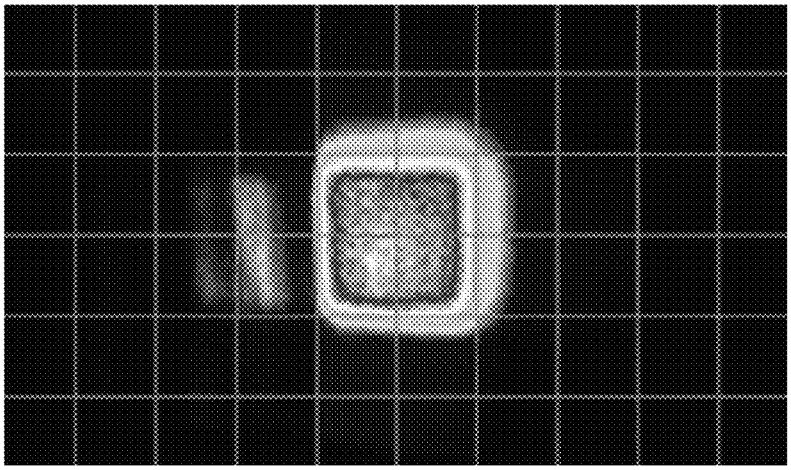
FIG. 5A is a diagram illustrating a light efficiency test of the lamp apparatus for an automobile using an LED as a light source according to the exemplary embodiment of the present invention.

FIG. 5A is a diagram illustrating a light efficiency test of the lamp apparatus for an automobile using an LED as a light source according to an exemplary embodiment of the present invention.

Figure 5B:
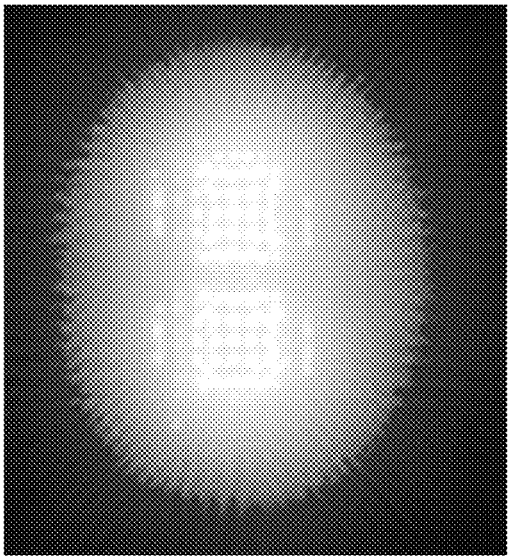
FIG. 5B is a diagram illustrating a lighting image of the lamp apparatus for an automobile using the LED as the light source according to the exemplary embodiment of the present invention.

FIG. 5B is a diagram illustrating a lighting image of the lamp apparatus for an automobile using the LED as the light source according to the exemplary embodiment of the present invention.

FIGS. 5A and 5B illustrate a test result using the lamp apparatus for the automobile according to the exemplary embodiment of the present invention, which is described with reference to FIG. 3.

The diagram illustrated in FIG. 5A illustrates an image acquired by photographing the lamp apparatus for the automobile including one 0.2 watt red LED light source under a condition of a 25° combined inclination angle, which emits light. In this case, the lamp apparatus distributes light of 17.3 cd and, unlike the description of FIG. 4A, it can be seen that the light distribution pattern does not concentrate on a predetermined direction and is positioned at the center.

The diagram illustrated in FIG. 5B illustrates a lighting image acquired by photographing the lamp apparatus for the automobile including two red (R) LED light sources in the front direction, which emits light. In this case, it can be seen that the lamp apparatus has improved light efficiency as compared with the lamp apparatus described with reference to FIG. 4B.

According to exemplary embodiments of the present invention, there are one or more effects as follows.

First, light efficiency is improved.

Second, a lens included in the present invention can be manufactured in a general injection machine.

Third, a cavity is provided in a first lens or a second lens to reduce a weight of a lamp apparatus, thereby improving fuel efficiency of an automobile.

Fourth, the lens can be manufactured by the general injection machine, the cavity is provided in the first lens or the second lens to save material cost, and a manufacturing cycle time can be reduced.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A lamp apparatus for an automobile, the apparatus comprising:

a light source configured to generate light; and a first lens configured to distribute the light to the outside and comprising a first cavity therein, a second lens configured to distribute the light to the outside and comprising a second cavity therein while contacting the first lens, wherein:

the first lens comprises:

a light spreading unit of which one side is convex toward the light source and the opposing side is flat; and a side portion connected with the one side of the light spreading unit and having a diameter which increases in a first direction away from the light source;

the light spreading unit comprises:

a curved portion which is convex toward the light source;

a first inner surface adjacent to the curved portion and extending toward the light source; and a first inner bottom surface which is flat and opposes the curved portion;

a diameter of an outer circumference of a base of the curved portion defined between the curved portion and the first inner surface is less than a diameter of the first inner bottom surface; and a length from the first inner bottom surface to the outer circumference of the base of the curved portion is greater than or equal to 1 mm and less than or equal to 2.5 mm.

2. The lamp apparatus of claim 1, wherein the side portion comprises:

an outer surface which is formed to form a predetermined angle with the first inner surface at one side of the first inner surface; and a second inner surface extending on the outer circumference of the first inner bottom surface and forming a predetermined angle with the first inner bottom surface.

3. The lamp apparatus of claim 2, wherein the angle between the first inner bottom surface and the second inner surface is greater than or equal to 90° and less than or equal to 180°.

4. The lamp apparatus of claim 1, wherein the second lens is formed to have a slope with the first direction.

5. The lamp apparatus of claim 4, wherein the slope is greater than or equal to 45° and less than or equal to 90°.

6. The lamp apparatus of claim 1, wherein the light source comprises a light-emitting diode.

7. The lamp apparatus of claim 1, wherein the first lens is made of an epoxy resin, a silicon resin, or an urethane resin.

8. The lamp apparatus of claim 1, wherein the light source comprises a fluorescent substance configured to vary a color of light.

9. The lamp apparatus of claim 1, wherein the second lens is made of an epoxy resin, the silicon resin, or the urethane resin.

* * * * *